United States Patent [19]

von Platen

[11] Patent Number: 4,461,129

[45] Date of Patent: Jul. 24, 1984

[54] METHOD AND MEANS FOR REDUCING THE HEAT CONSUMPTION IN A BUILDING OR THE LIKE

[76] Inventor: Magnus H. B. von Platen, Sjödiken 19, S-233 00 Svedala, Sweden

[21] Appl. No.: 305,635

[22] PCT Filed: Jan. 19, 1981

[86] PCT No.: PCT/SE81/00010

§ 371 Date: Sep. 21, 1981

§ 102(e) Date: Sep. 21, 1981

[87] PCT Pub. No.: WO81/02176

PCT Pub. Date: Aug. 6, 1981

[30] Foreign Application Priority Data

Jan. 22, 1980 [SE] Sweden ..... 8000488

[51] Int. Cl.[3] ..... E04H 14/00

[52] U.S. Cl. ..... 52/173 R; 52/262

[58] Field of Search ..... 52/173 R, 24–27, 52/262; 256/12.5, 1, 24

[56] References Cited

U.S. PATENT DOCUMENTS

| | | | |
|---|---|---|---|
| 1,408,432 | 3/1922 | Arnold | 52/173 |
| 1,902,783 | 3/1933 | Kruckenberg et al. | 256/12.5 |
| 2,206,040 | 7/1940 | Ludington | 52/173 |
| 2,270,537 | 1/1942 | Ludington | 52/173 |
| 2,270,538 | 1/1942 | Ludington | 52/173 |
| 2,765,994 | 10/1956 | Jordanoff | 256/12.5 X |
| 3,280,524 | 10/1966 | Hull | 52/173 |
| 3,817,009 | 6/1974 | Elder | 52/173 |
| 3,828,498 | 8/1974 | Jones | 52/173 |
| 3,866,363 | 2/1975 | King | 52/173 |
| 4,005,557 | 2/1977 | Kramer et al. | 52/173 R |
| 4,122,675 | 10/1978 | Polyak | 52/173 R |
| 4,142,340 | 3/1979 | Howard | 52/262 |
| 4,193,234 | 3/1980 | Wong | 52/173 |

FOREIGN PATENT DOCUMENTS

| | | | |
|---|---|---|---|
| 246765 | 5/1966 | Austria | 256/12.5 |
| 1181074 | 2/1970 | United Kingdom | 52/173 |

*Primary Examiner*—J. Karl Bell

*Attorney, Agent, or Firm*—Finnegan, Henderson, Farabow, Garrett & Dunner

[57] ABSTRACT

The invention relates to a method for reducing the heat consumption in a building or the like. This is brought about by the fact that the air movement caused by free winds close to the external surfaces of the building or the like is reduced by means of air permeable screens which are applied close to the external surfaces of the building or the like. They may also be applied close to external surfaces of other adjacent buildings or the like. The screens are disposed substantially transversely to the dominant direction of the free winds along the last-mentioned surfaces.

The invention also relates to means for carrying out the method, consisting of one or more air permeable wind screens which are fitted to the building or the like.

12 Claims, 15 Drawing Figures

METHOD AND MEANS FOR REDUCING THE HEAT CONSUMPTION IN A BUILDING OR THE LIKE

Figure 1:
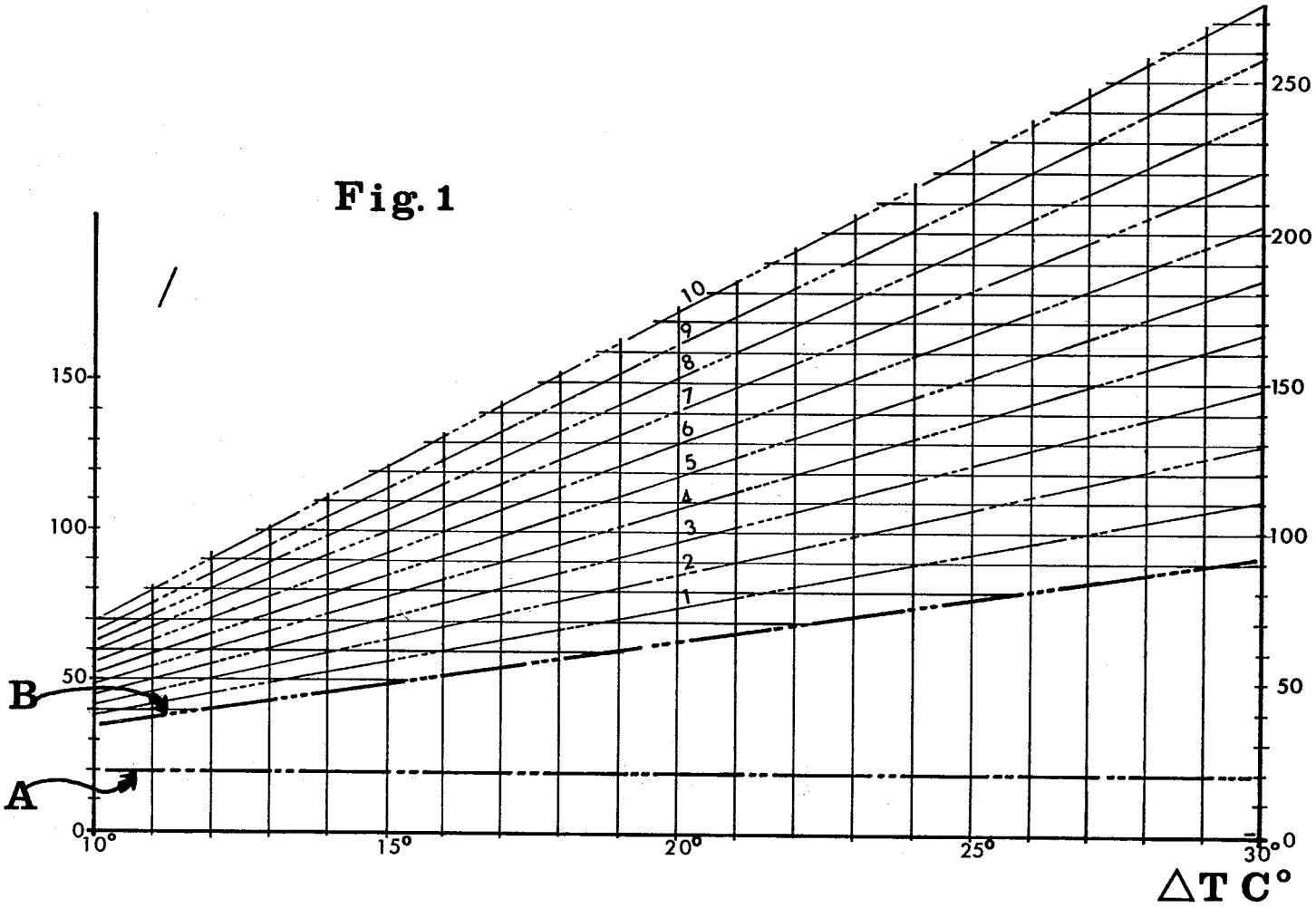

The present invention relates to a method for reducing the heat consumption in a building or the like.

The invention also relates to a device for carrying out the method.

The rising prices of energy and the resulting intensified energy saving have led to attempts being made to make dwelling houses as niggardly of energy as possible. This is preferably done by reducing the transmission losses through the walls and the roof of the house, which is brought about by improved insulation, the installation of double-glazing etc., that is to say by improving the K value of the building construction, but it is also done by reducing ventilation losses and leakages of air, which is brought about by heat recovery in the ventilation system or by sealing slight openings at windows and doors and other undesirable air passages.

It is well known that in order to retain a certain internal temperature more powerful heating is required when it is windy than when it is still even if the temperature outside is the same, and according to the current notion this is associated with the fact that the "draught" in the house increases with increasing wind. As a consequence thereof wind screens are used at the houses, facing the prevailing direction of the wind, curtains of vegetation and hedges having long been used for this purpose. In recent times, artificial wind screens in the form of wind nets have also come into use, particularly at greenhouses and often in combination with curtains of vegetation. The wind screens are placed in the terrain round the house at a suitable distance from this, so that the house is in the sheltered zone behind the wind screen.

The invention is based on recognition of the fact that the wind not only gives rise to a "draught" in the house and so increases ventilation losses and leakages of air, but also to a high degree influences the transmission losses through the walls and roof of the house; thus the technical design of the building alone is not decisive for the magnitude of the transmission losses. A flow of heat from the various surfaces of the house to the surrounding air takes place through convection as soon as the surfaces acquire a higher temperature than the air outside. The transfer of heat through walls and roof is the greater, the greater the difference in temperature, and a convection stream develops at the outside of the walls and roof, the velocity of which increases as the difference in temperature increases. According to what the inventor has found, the air close to the surfaces of the house moves more quickly, with increasing wind, than the natural convection occuring as stated above, and thus the transmission losses also increase noticeably since the outer layer of heated air which, in calm weather, is immediately next to the external surface of the house and provides an increased resistance to heat transfer, is swept away more or less quickly by the stream of air passing along the surface with the result that the transmission losses increase.

It is generally known that stationary air constitutes an excellent heat insulating material, and it is therefore important that as thick a layer of air as possible can be disposed round heated or cooled buildings to reduce the transmission losses. On the other hand, it is not necessary for this stationary or relatively stationary layer of air to be built into the envelope of the building. The layer of air produces a better effect externally of the envelope, since the valuable irradiation of solar energy is not prevented when stationary air is not enclosed in another material, for example glass wool, plastics, etc., as when the envelope of a building is insulated in traditional manner, the irradiation being excluded to the extent that the insulation is increased. This is particularly obvious in connection with greenhouses.

In order to reduce considerably and in the optimum case substantially to eliminate the said thermal effect of the wind, the method according to the invention for reducing the heat consumption in a building or the like, particularly in a dwelling house, has obtained the features appearing from claim 1.

The invention also relates to means for carrying out the method in accordance with claim 4.

To apply wind screens to buildings in not a novelty in itself. Thus, in the Norwegian laid-open specification Nos. 131,399 means are described for preventing reduced pressure on flat or slightly inclined roofs, the outer edge of which ends with a breast which forms a continuation of the house wall. The means comprise a guide surface in the form of a plate above the breast, spaced therefrom, so that some of the wind which is forced up along the wall and the breast, is guided in over the roof by means of the guide surface. The object of this is that in the specific roof constructions referred to in the laid-open specification, the roof should be prevented from being wholly or partially torn loose as a result of the reduced pressure which develops over the roof.

In the German laid-open specification No. 2,317,545 means are described for reducing or eliminating sucking forces which are generated by the wind at flat or slightly inclined roofs. Such means comprise interference elements which project beyond the boundary edge of the roof and the purpose of which is to disturb the flow conditions of the wind while reducing or eliminating the formation of turbulence. The interference elements can have the form of air permeable gratings.

Thus, both these previously known means relate to the application of screens to specific roof constructions in order to reduce the dynamic effect of the wind on the roof construction. On the other hand, the thermal effect of the wind has not been taken into consideration by these proposals and no means have been suggested of reducing the heat consumption in buildings or the like through influence on this thermal effect.

Figure 2:
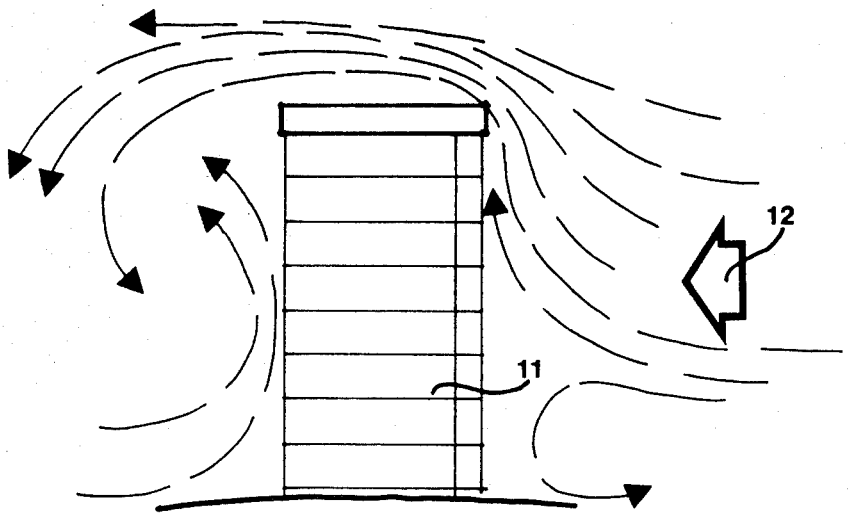
Figure 3:
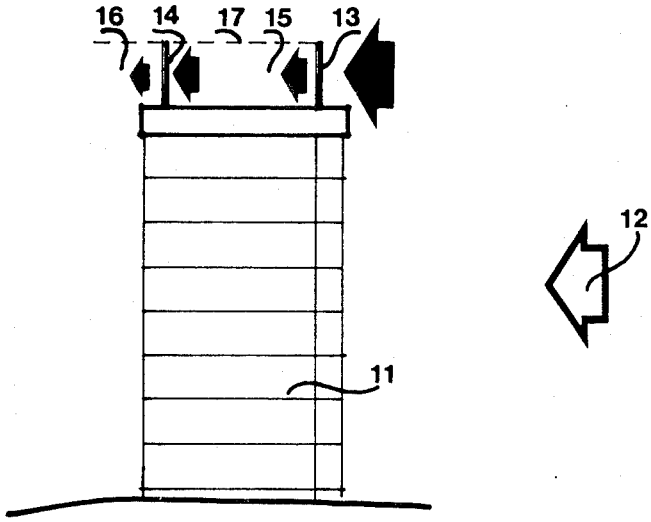
Figure 4:
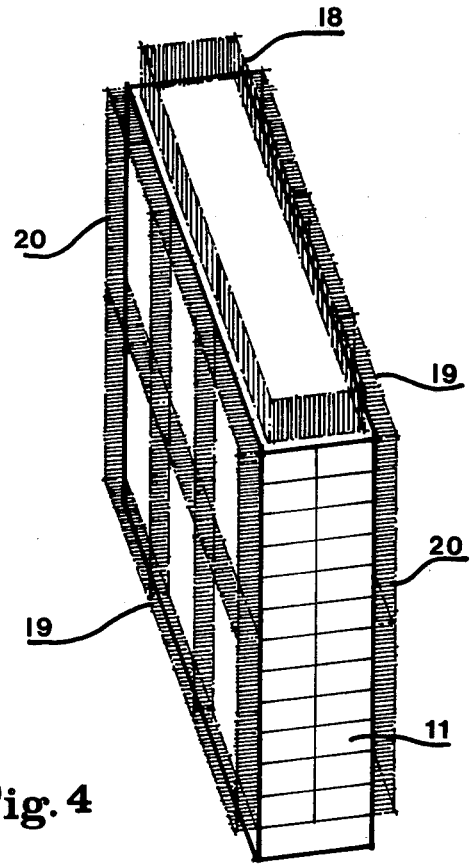
Figure 5:
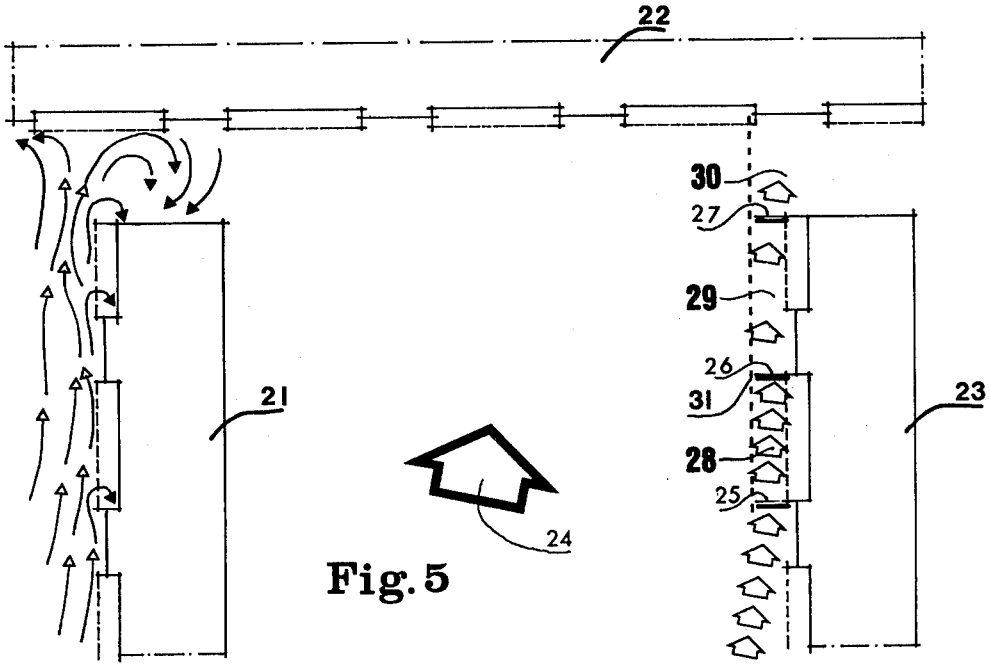
Figure 6:
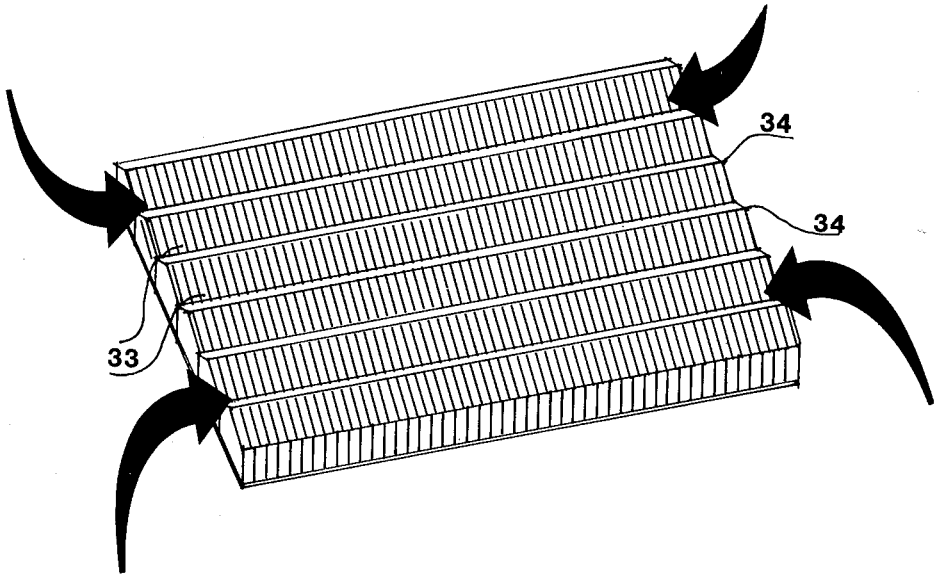
Figure 7:
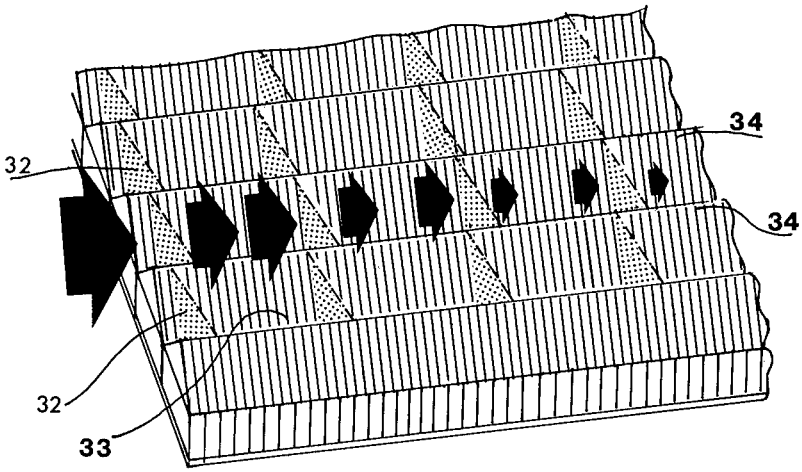
Figure 8:
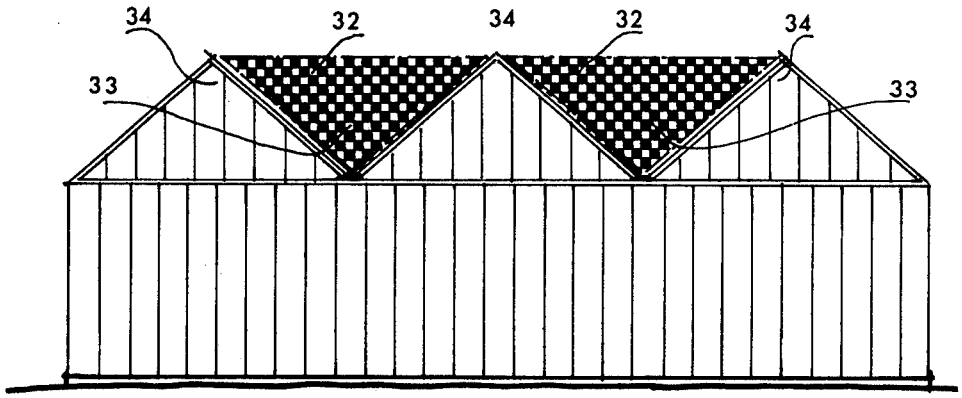
Figure 9:
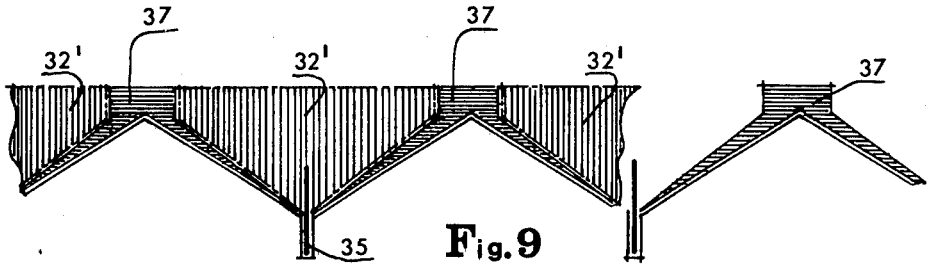
Figure 10:
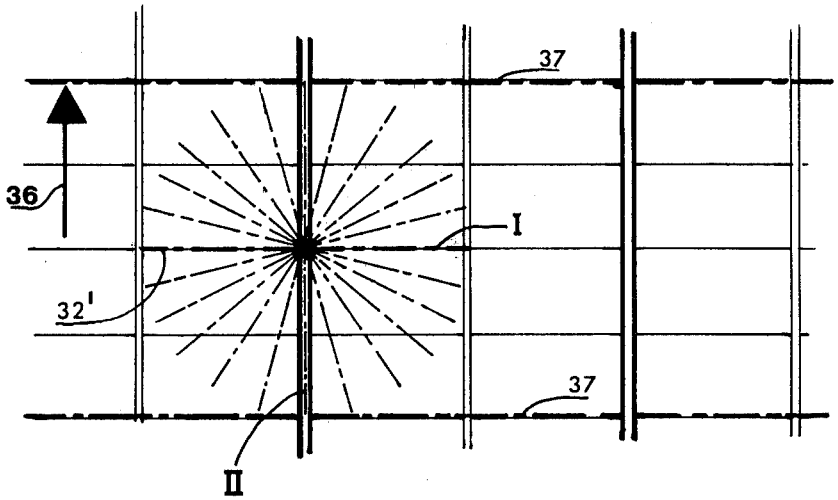
Figure 12:
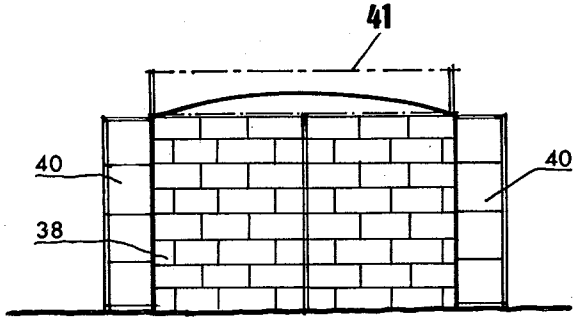
Figure 13:
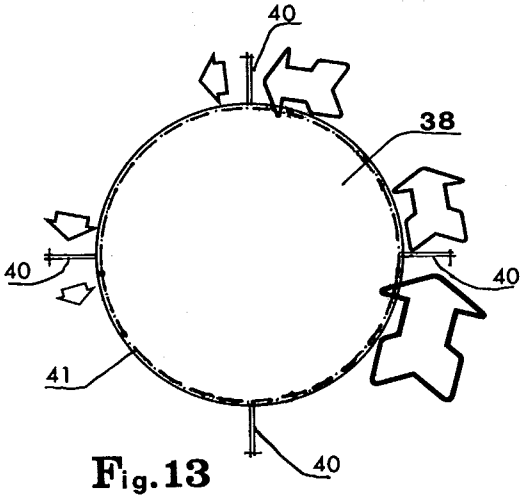
Figure 11:
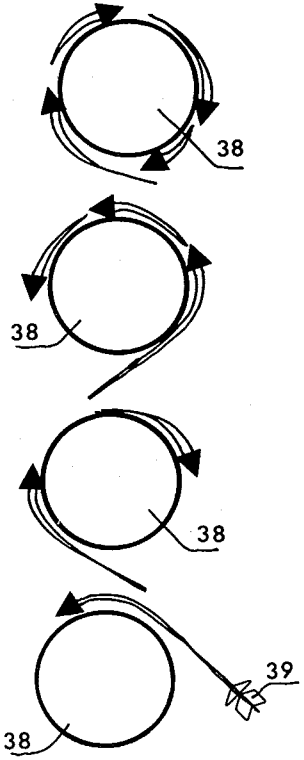
Figure 15:
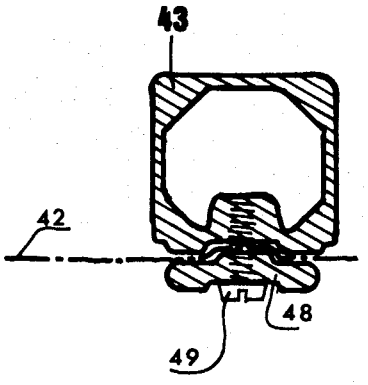
Figure 14:
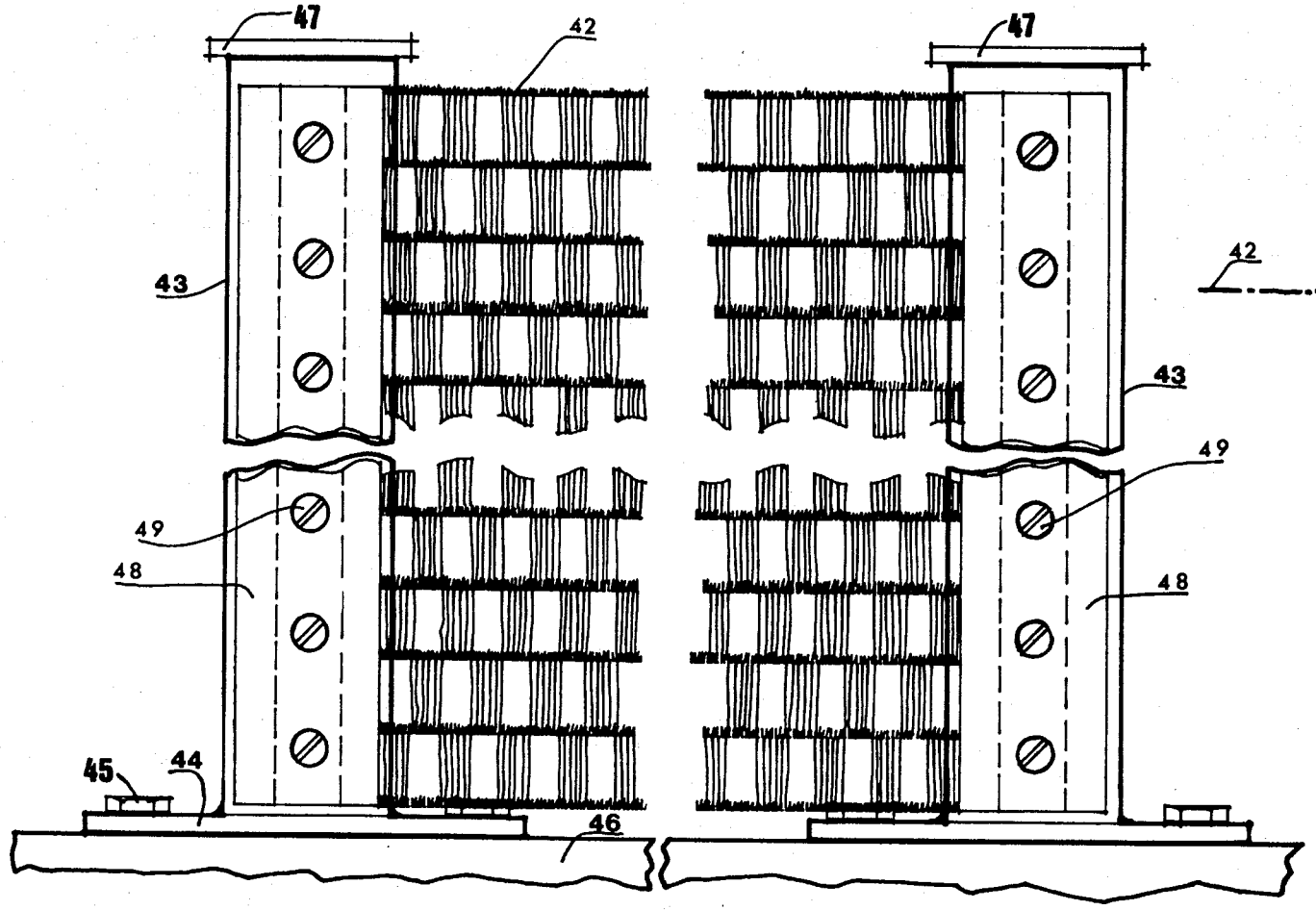

In order to explain the invention, this will be described in more detail below with reference to the accompanying drawings in which FIG. 1 is a graph which shows the heat consumption in a house, FIG. 2 is a diagrammatic elevational view of a house, illustrating the streams of air caused by the wind round the house, FIG. 3 is a view, corresponding to FIG. 2, with wind screens mounted on the roof to reduce the thermal effect of the wind on the energy consumption in the house, FIG. 4 is a diagrammatic perspective view of a house with wind screens mounted, according to the invention, both on the roof and on the facades, FIG. 5 is a diagrammatic plan view of a number of houses, illustrating the streams of air and a further embodiment of the means according to the invention, FIG. 6 is a diagrammatic perspective view of a greenhouse, illustrating the streams of air over the roof of the greenhouse, FIG. 7 is a partial perspective view of the greenhouse in FIG. 6 provided with means for using the method according to the invention, FIG. 8 is an enlarged end view of part of the greenhouse in FIG. 7, FIG. 9 is a partial diagrammatic view similar to that in FIG. 8, illustrating a modified embodiment of the means according to the invention, FIG. 10 is a partial diagrammatic plan view of the means in FIG. 9, FIG. 11 is a diagrammatic plan view of a plurality of cylindrical oil storage tanks, FIG. 12 is a side view of an individual oil storage tank provided with a device for using the method according to the invention, FIG. 13 is a plan view of the oil storage tank in FIG. 12, FIG. 14 is a broken elevational view of a constructional embodiment of a wind screen, and FIG. 15 is a cross-sectional view of one of the poles of the wind screen in FIG. 14.

As stated at the beginning, not only the ventilation losses and air leakages are influenced by the wind but also the transmission losses through walls and roof. The heat losses due to the wind are of course different in each case, since they depend on how the house is designed and situated and their proportion in the total heat losses varies depending on whether the house is situated in a more or less windy tract of land. The graph in FIG. 1, to which reference is first made, relates to a particularly free-standing house, situated in the southernmost part of Sweden, and has been drawn up on information from measurements carried out in practice, during a heating season from October to May. In the graph, the difference between the inside temperature and the outside temperature, designated ΔT, is given in degrees C on the horizontal axis, while the energy consumption per day is given in kWh on the two vertical axes (kWh/24h). The part of the energy consumption which relates to energy losses via housekeeping and tap water, is indicated by a horizontal dot and dash line A. This energy loss is largely independent of what difference in temperature and what wind speed prevails on the occasion. On top of this energy loss is the energy loss which is represented by the transmission losses through walls and roof and with respect to calm weather it is indicated by a dot and dash line B. As can easily be seen, this energy loss depends not only on the prevailing difference in temperature but also on whether it is more or less windy, which is illustrated in the graph by a number of dot and dash lines 1–10 above the line B, where the figures on the respective lines indicate the wind speed occurring in m/s. As can be seen, the energy loss due to the wind above the line B constitutes a significant part of the total energy consumption. It includes two types of loss, on the one hand the transmission losses caused by the thermal effect of the wind and on the other hand ventilation losses. The transmission losses increase greatly even at low wind speeds while the ventilation losses increase greatly only at higher wind speeds. Together the two types of heat loss due to the wind form a combination which follows the formula $$\Delta T \times V \times A = Q$$

in which

ΔT is the difference between the outside and inside temperatures in °C.

V is the wind speed in m/s

A is a constant

Q is the heat loss in kWh/24h

In a well-insulated and well-sealed house such as that the graph relates to, the energy losses due to the wind consist mainly of the transmission losses due to the wind. The energy loss due to the wind constitutes such a significant part of the total energy consumption at every existing difference in temperature ΔT that it appears more than well motivated to attack this part of the energy consumption and to try to reduce it, which can be done, by using the present invention, at investment costs which are insignificant in relation to the result.

FIG. 2, to which reference is now made, shows the air movements at a building 11 when the direction of the wind is that which is indicated by means of the large arrow 12. At the windy side, that is to say the right-hand side of the building as seen in FIG. 2, an excess pressure develops which leads to increased wind speed round the building but particularly over the roof of the building. At the lee side of the building, the left-hand side in FIG. 2, a reduced pressure develops. It is very difficult to seal a building when these differences in pressure prevail. The consequence is that great ventilation losses occur as well as great air leakage in the form of unintentional ventilation, which increases with the wind speed.

Even more important, however, is the fact that the reduced pressure at the lee side initiates an air movement which tends to equalize the difference in pressure. Cold air which thus has not been heated by the building, flows in from the environment. The outer layer of heated air which, in calm weather, is immediately next to the external surface of the building and provides an increased resistance to heat transfer, is swept away with the result that the transmission losses increase.

The flow of air can be influenced to reduce the transmission losses due to the wind and at the same time also the ventilation losses and the air leakage, by fitting wind screen means comprising wind screens in the manner shown in FIG. 3. Two wind screens 13 and 14 are mounted on the roof of the building. The excess pressure at the windy side is not influenced by the wind screens but on the other hand the reduced pressure at the lee side will be considerably lower by the wind speed being influenced by the two wind screens 13 and 14 located at a high level. If the wind screens are assumed to have a porosity of about 50%, the wind speed drops on passage through the first wind screen 13 by about 50% and on passage through the second wind screen 14 the already reduced wind speed drops to 25% of the speed of the free wind. At experiments carried out, it was found that the optimum result is obtained when the wind screen causes a wind reduction of 40–60%. By means of the wind screens 13 and 14, lee zones 15 and 16 are obtained, the upper limit of which is indicated by a dot and dash line 17. As is apparent, zone 15 is also a free space between adjacent screens 13, 14.

As a result of the fact that wind screens are arranged in the manner shown in FIG. 3, significant amounts of heating energy are saved. Through the invention, therefore, an old constant error in the method of calculating the transmission losses for a building is unveiled, namely that the dependence on the wind is not included in calculating the heat transmission coefficient, the so-called K value.

The wind screens 13 and 14 may consist of wind nets of one of the types available on the market. For example wind nets of textile material, such as Ritza 6508, which are manufactured by Messrs. Julius Koch, Copenhagen, Denmark, can be fixed substantially vertically between poles or in frames, but it is also possible to provide nets or gratings of metal as wind screens. The effect of the wind screen, the so-called lee effect, which can be designated by r, is defined by the relationship $$r = \frac{V - Vr}{V} \times 100$$

in which p1 V=the speed of the free wind in m/s

Vr=the speed of the wind behind the wind screen in m/s.

The lee effect is expressed in percentage of the speed of the free wind by this relationship.

A further improvement in the effect of the wind screen means with regard to saving heating energy can be achieved by providing the building with further wind screens as shown in FIG. 4. According to this figure, a rectangular wind screen 18 is disposed on the roof of the building while the two facades are provided with both horizontal wind screens 19 and vertical wind screens 20, which project substantially at right angles from the facades. The gables can also be provided with wind screens in a corresponding manner. Regardless of the direction from which the wind blows, a considerable reduction in the speed of the wind is obtained by this arrangement at the external surfaces of the building and hence a reduction in the transmission losses.

FIG. 5 shows another situation where lee zones are brought about by means of wind screens. Three buildings 21, 22 and 23 are shown in the figure. The building 21 is not provided with wind screen means and air movements occur in traditional manner with increasing wind speed and turbulent flow towards the buildings 21 and 22, as indicated by means of the arrows. Such flow demands much energy since the heated layer of air close to the external surfaces of the buildings is blown away with the result that the resistance to heat transfer is reduced and the transmission losses increase. The building 22, which lies in the extension of the building 21, is exposed to the increased wind speed which develops along the facade on the building 21 and therefore suffers severely.

In FIG. 5, the building 23 has been provided with wind screen means comprising wind screens 25, 26, and 27 which project freely and substantially at right angles from the facade of the building 23 spaced in the longitudinal direction of the facade. Suitable securing points for the wind screens are the side members of balconies since the screens then reach out to the maximum from the facade and the lee zones are then larger. The three wind screens provide free spaces or lee zones 28, 29 and 30, the outer limit of which is indicated by a dot and dash line 31. The wind speed will be reduced along the facade of the building 23 by means of the three wind screens so that the building 22 in the extension of the building 23 is not affected by increasing wind speed and heat losses associated therewith. Obviously, all the buildings in FIG. 5 can be provided with wind screens in the manner shown in FIGS. 3 and 4.

Greenhouses or hothouses in particular require large amounts of energy in a cold climate, and this energy must be supplied via a heating system during a large part of the year when the solar radiation is not sufficiently intense to maintain the necessary temperature in the greenhouse. Wind screens to create lee zones are then very useful, particularly as greenhouses have a very poor K value. At present, wind screens of vegetation are used, but artificial wind screens also occur which are then anchored in the ground at a certain distance from the actual greenhouse or block of greenhouses. The distance must be ample so that the wind screens do not hamper the solar radiation. The disadvantages of wind screens which are anchored in the ground are several: the height of the construction is considerable, the maximum moment at the plane of the ground is great, and in consequence of this the costs are relatively high per kWh saved.

FIG. 6 shows a block of greenhouses of a type which commonly occurs (Venlo). Greenhouses of this type have pitched roofs, and when a plurality of greenhouses are arranged in a block in the manner shown in FIG. 6, valleys 33 are formed between adjacent pitched roofs 34, and the flows of air are channelled into these valleys and sweep through these as illustrated by the arrows in FIG. 6.

FIGS. 7 and 8 show how the invention can be used on a block of greenhouses of the type shown in FIG. 6. Wind screen means comprising triangular wind screens 32 are provided in the valleys 33 between adjacent pitched roofs 34 and prevent the air movements through the valleys from sweeping away the heated layer of air close to the external surfaces of the pitched roofs. Thus, in this case, the wind screens are relatively small and they can be offset somewhat in relation to one another in adjacent valleys, as shown in FIG. 7, so as to hamper the solar radiation in the greenhouse to a lesser extent. Each wind screen preferably reduces the wind speed by about 50% so that the air in the valleys becomes almost stationary, after the wind has passed a sufficient number of screens. When this situation occurs, the transmission losses in the roof of the greenhouse have been considerably reduced and the unwanted ventilation has almost ceased.

Wind screens can be disposed and fitted in the manner shown in FIGS. 7 and 8 also on other buildings with pitched roofs than greenhouses, for example on the roof of an industrial building provided with skylights. The very small wind screens 32, when applied to greenhouses for example, can be made pivotable so as to be able to follow the progess of the sun and so that there may be as little loss of irradiated solar energy as possible.

FIGS. 9 and 10 show such a construction. Here, the wind screen means comprises wind screens 32' which are pivotally mounted by means of a bearing arrangement 35 at the bottom of the valley 33 between two adjacent pitched roofs 34 for pivoting about a substantially vertical axis. In this manner, the wind screen 32' can be adjusted in different positions according to the incident solar radiation so that the wind screen shades the inside of the greenhouse as little as possible. If it is assumed that the northerly direction is that indicated by an arrow 36 in FIG. 10, the wind screen 32' is adjusted in an east-west direction in the morning at 6 o'clock, and this position is designated by I in FIG. 10. The wind screen is then turned in clockwise direction with respect to FIG. 10 according to the apparent movement of the sun in the sky to assume a north-south position at midday, designated by II, and then to resume the position I in the evening at 6 o'clock. The wind screen can easily be adjusted automatically by means of a time-controlled servo device. In the embodiment shown in FIGS. 9 and 10, the wind screens 32' are supplemented by further wind screens 37 on the ridges of the pitched roofs 34 and have portions which extend down with decreasing height along the surfaces of the pitched roof. The wind screens 37 are mounted stationary since they are considerably smaller than the wind screen 32' and cause insignificant shading inside the greenhouse.

When wind screens are provided on a pitched roof, it has been found that the optimum spacing between the wind screens is 4–6 times the height of the wind screens as measured from the lowest point in the valley between the pitched roofs to the upper edge of the wind screen.

In connection with the invention, a building or the like does not only refer to conventional houses with heating but also to other constructions which are not buildings in the actual sense but with which it is nevertheless of interest to save thermal energy taking into consideration the thermal effect of the wind. Examples of such constructions are storage tanks for heavy oil which is kept heated in the storage tanks.

In FIG. 11, to which reference is now made, there is shown a row of cylindrical oil storage tanks 38. When the wind blows against these storage tanks in the direction of the arrow 39, streams of air are formed round the storage tanks substantially in the manner indicated by the arrows in FIG. 11. In the same manner as previously described, the heated layer of air round the storage tanks is thus blown away from an increase in the transmission losses as a result.

FIGS. 12 and 13 show how the invention is applied to a storage tank to reduce the transmission losses due to the wind. Wind screen means comprising wind screens 40 are disposed with a spacing of 90° on the cylindrical wall of the storage tank and project radially therefrom, while a wind screen 41 is disposed round the roof of the storage tank along its periphery. The speed of the wind which sweeps round the oil storage tank is successively reduced as the wind passes through the wind screens 40 as indicated by the arrows in FIG. 13. In the same manner as previously described, the wind screen 41 reduces the speed of the wind which blows over the roof of the oil storage tank.

As previously stated, the wind screens may consist of wind nets of textile or metal material which are fixed between poles or are mounted in frames. It would not involve any great difficulty for an average designer to design such a wind screen but for the sake of completeness a preferred embodiment of a wind screen fur using the method according to the invention is shown in FIGS. 14 and 15.

A wind net 42 of the Ritza type previously mentioned is fixed between two poles 43 which are here shown as having hollow sections. The poles have a base plate 44 at one end and are secured by means of bolts 45, which go through the base plate, to the building 46 on which the wind screen is mounted. At the other end, the pole is closed by means of an end cover 47. The wind net 42 is fixed to the poles by means of a rail 48 which is fixed to the pole by means of screws 49, the wind net being gripped between rail and pole. Since the wind net 42 and hence the poles 43 are exposed to heavy loading in a strong wind, it may be necessary to brace the poles 43.

A similar securing of the wind net can be used when the wind net is secured in a frame, as is necessary for wind screens on buildings with pitched roofs as shown in FIGS. 7–10. It is also possible to provide gratings which are stiff in themselves, or perforated discs or plates as wind screens. The wind screens according to the invention may also be included in the actual building construction. For example, balconies can be given such a shape and be made of a material which transmits air so that they form wind screens and provide suitable lee zones along the facade of the building. Also in the restoration of high dwelling houses in particular, the method of combining balcony construction with wind screens can be successful.

Reducing the energy losses due to wind by using the invention means that the saving in energy can be made in the cheapest manner, since the investment which is required to fit the wind screens is low in relation to the amount of energy saved as a result. It is a further advantage of the invention that it can be used at the same cost in existing buildings as in new production. In many cases, the wind screens can be integrated with the architectural design of a building.

I claim:

1. A method of reducing the heat consumption in a building or the like, comprising the steps of providing a plurality of spaced, substantially parallel, air permeable screen means on an external surface of the building or the like substantially transversely to the dominant direction of the free winds along said surface said projecting freely therefrom with a free space between adjacent screen means, said screen means each being constructed for providing a reduction in wind speed passing therethrough of from about 40% to about 60%.

2. A method according to claim 11, including the step of providing a plurality of spaced, substantially parallel air permeable screen means on a plurality of surfaces of said building or the like.

3. A method according to claim 1, including the step of providing a first plurality of spaced, substantially parallel air permeable screen means on an external surface of the building or the like, and providing a second plurality of spaced, substantially parallel, air permeable screen means on said external surface and substantially perpendicular to said first screen means.

4. Means for reducing the heat consumption in a building or the like having external surfaces, comprising a plurality of spaced, substantially parallel, air permeable wind screen means mounted on at least one of the surfaces of the building or the like and projecting freely therefrom substantially at right angles thereto with a free space between adjacent screen means, said screen means each being constructed for providing a reduction in wind speed passing therethrough from about 40% to about 60%.

5. Means as claimed in claim 4, said wind screen means comprising wind screens being disposed over substantially the entire dimension of said building surface.

6. Means as claimed in claim 4, said wind screen means comprising screens including a first plurality of substantially parallel screens and a second plurality of substantially parallel screens, said first and second screens being substantially perpendicular to each other.

7. Means as claimed in claim 4, said wind screen means comprising screens being disposed on the roof of the building or the like along its entire periphery.

8. Means as claimed in claim 4, said building including a plurality of pitched roofs which are disposed side-by-side forming alternate ridges and valleys, said wind screens including screens fitted in the valleys between the pitched roofs.

9. Means as claimed in claim 8, including screens on the ridges of the pitched roofs.

10. Means as claimed in claim 8, said screens being pivotally mounted for adjustment relative to the pitched roofs.

11. Means as claimed in claim 4, said parallel wind screen means being arranged at a mutual spacing which is from about four to about six times the height of the wind screens.

12. Means as claimed in claim 4, said wind screen means comprising fixed nets.

* * * * *

UNITED STATES PATENT AND TRADEMARK OFFICE

CERTIFICATE OF CORRECTION

PATENT NO. : 4,461,129

DATED : July 24, 1984

INVENTOR(S) : Magnus H. B. von Platen

It is certified that error appears in the above—identified patent and that said Letters Patent is hereby corrected as shown below:

Column 8, line 32, "11" should read --1--.

Signed and Sealed this

*Nineteenth* Day of *March 1985*

[SEAL]

*Attest:*

DONALD J. QUIGG

*Attesting Officer*

*Acting Commissioner of Patents and Trademarks*